US010665050B2

(12) United States Patent
Ito

(10) Patent No.: US 10,665,050 B2
(45) Date of Patent: May 26, 2020

(54) MONEY HANDLING APPARATUS, MONEY HANDLING SYSTEM, AND MONEY HANDLING METHOD

(71) Applicant: GLORY LTD., Hyogo (JP)

(72) Inventor: Keita Ito, Hyogo (JP)

(73) Assignee: GLORY LTD., Hyogo (JP)

( * ) Notice: Subject to any disclaimer, the term of this patent is extended or adjusted under 35 U.S.C. 154(b) by 0 days.

(21) Appl. No.: 16/357,833

(22) Filed: Mar. 19, 2019

(65) Prior Publication Data

US 2019/0304235 A1 Oct. 3, 2019

(30) Foreign Application Priority Data

Mar. 27, 2018 (JP) ..... 2018-060533

(51) Int. Cl.

| | |
|---|---|
| ***G07F 19/00*** | (2006.01) |
| ***G07D 11/30*** | (2019.01) |
| ***G07D 11/13*** | (2019.01) |
| ***G07G 1/00*** | (2006.01) |
| ***G07D 11/12*** | (2019.01) |
| ***G07D 11/40*** | (2019.01) |
| ***G07D 11/00*** | (2019.01) |

(52) U.S. Cl.
CPC ..... *G07D 11/30* (2019.01); *G07D 11/009* (2013.01); *G07D 11/12* (2019.01); *G07D 11/13* (2019.01); *G07D 11/40* (2019.01); *G07G 1/0027* (2013.01)

(58) Field of Classification Search
CPC .... G06Q 20/1085; G06Q 20/20; G07D 11/00; G07D 11/12; G07D 11/13; G07G 1/0036; G07G 1/0045
USPC ..... 235/379, 380, 383, 385
See application file for complete search history.

(56) References Cited

U.S. PATENT DOCUMENTS

| | | | | |
|---|---|---|---|---|
| 5,918,740 | A * | 7/1999 | Berry, Jr. | A61C 19/02 206/369 |
| 6,067,530 | A * | 5/2000 | Brooks, Jr. | G06Q 20/206 705/30 |
| 9,396,620 | B2 * | 7/2016 | Takayama | G07F 19/202 |
| 2005/0060055 | A1 * | 3/2005 | Hallowell | G07D 7/0043 700/95 |

FOREIGN PATENT DOCUMENTS

| | | |
|---|---|---|
| JP | 2015092326 A1 | 5/2015 |
| JP | 2015-108909 | 6/2015 |

OTHER PUBLICATIONS

European Search Report, European patent Office, Application No. 19164900.3, dated Aug. 6, 2019.

* cited by examiner

*Primary Examiner* — Daniel St Cyr
(74) *Attorney, Agent, or Firm* — Greenblum & Bernstein, P.L.C.

(57) ABSTRACT

When a banknote cassette is taken out from a change machine installed in a store A in which a money handling apparatus is installed and is mounted to the money handling apparatus, the money handling apparatus specifies a store, stores banknotes, calculates a fee, and updates the proceeds from sales and the fee. In this case, since the store A in which the money handling apparatus is installed is specified, the fee is "0", and the proceeds from sales of the store A is updated. Meanwhile, when a banknote cassette is taken out from a change machine installed in another store B, a fee to be paid by the store B is calculated, and the proceeds from sales and the fee of the store B are updated.

17 Claims, 13 Drawing Sheets

FIG.6

| | |
|---|---|
| CASSETTE ID | C009 |
| STORE ID | U002 |
| CASH REGISTER ID | R001 |
| FEE SETTING | AMOUNT OF STORED MONEY × 0.02 |
| AMOUNT OF STORED MONEY | 427,000 YEN |
| : | : |

FIG.12

INVENTORY AMOUNT DATA
106a

| | |
|---|---|
| 10,000-YEN NOTE | 47 |
| 5,000-YEN NOTE | 3 |
| : | : |

FIRST STORE PROCEEDS DATA
106b

| | |
|---|---|
| STORE ID | U001 |
| TYPE | FIRST STORE |
| FEE | NOT REQUIRED |
| DAY'S PROCEEDS FROM SALES | 213,000 YEN |
| : | : |

SECOND STORE PROCEEDS DATA
106c

| | |
|---|---|
| STORE ID | U002 |
| TYPE | SECOND STORE |
| FEE | 8,540 YEN |
| DAY'S PROCEEDS FROM SALES | 427,000 YEN |
| : | : |

MONEY HANDLING APPARATUS, MONEY HANDLING SYSTEM, AND MONEY HANDLING METHOD

BACKGROUND OF THE INVENTION

Field of the Invention

The present invention relates to a money handling apparatus, a money handling system, and a money handling method which manage proceeds from sales of stores.

Description of the Background Art

Conventionally, it has been well known that money depositing machines for storing therein money as proceeds from sales of the stores are installed in stores such as supermarkets. For example, Japanese Laid-Open Patent Publication No. 2015-108909 discloses a money depositing machine including a coin depositing unit, a coin recognition unit, a temporary storage unit, a memory unit, and a storage unit. This money depositing machine is configured to calculate the total weight of coins to be stored in the storage unit, by using the denominations and the number of coins, in the temporary storage unit, which are stored in the memory unit.

For example, a money cassette, which has been taken out from a change machine installed in a store, is mounted to the money depositing machine. Then, money stored in the money cassette is fed out and stored in the storage unit of the money depositing machine, whereby the proceeds from sales in the change machines installed in the store can be collected into the money depositing machine.

SUMMARY OF THE INVENTION

Although some small-scale stores have already introduced a change machine and a cash register having a POS (Point of Sales) function (hereinafter referred to as "POS register"), they have not yet introduced such a money depositing machine. In the stores that have not introduced the money depositing machine, for example, proceeds from sales need to be manually managed. It may cause a problem that the proceeds from sales cannot be accurately managed.

The present invention is made to solve the aforementioned problem in the conventional art, and an object of the present invention is to provide a money handling apparatus, a money handling system, and a money handling method which are capable of efficiently managing proceeds from sales of a store that has not introduced an apparatus for managing the proceeds from sales.

In order to solve the above problems, a money handling apparatus according to one aspect of the present invention is installed in a predetermined store and is configured to handle depositing of money as proceeds from sales of at least the predetermined store. The apparatus includes: a money receiving unit configured to receive money as proceeds from sales of at least one of other stores different from the predetermined store; a determination unit configured to determine a store corresponding to the money received by the money receiving unit; a money storage unit configured to store therein the money received by the money receiving unit; and a memory unit configured to store therein information on proceeds from sales of each store.

A money handling system according to another aspect of the present invention comprises: a money handling apparatus which is installed in a predetermined store and is configured to handle depositing of money as proceeds from sales of at least the predetermined store; a first in-store apparatus installed in the predetermined store; and a second in-store apparatus installed in another store different from the predetermined store. The money handling apparatus includes: a money receiving unit configured to receive money stored in the first in-store apparatus and money stored in the second in-store apparatus; a determination unit configured to determine a store corresponding to money received by the money receiving unit; a money storage unit configured to store the money received by the money receiving unit; and a memory unit configured to store therein information on proceeds from sales for each store.

A money handling method according to another aspect of the present invention is performed by a money handling apparatus which is installed in a predetermined store, and is configured to handle depositing of money as proceeds from sales of at least the predetermined store. The method includes: a money receiving step of receiving money as proceeds from sales of another store different from the predetermined store; a determination step of determining a store corresponding to the money received in the money receiving step; a money storage step of storing, in a money storage unit, the money received in the money receiving step; and a memory step of storing, in a memory unit, information on proceeds from sales for each store.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 shows specific examples of data stored in an IC tag;

FIG. 12 shows specific examples of data stored in the money handling apparatus.

DESCRIPTION OF THE PREFERRED EMBODIMENTS

Hereinafter, a money handling apparatus, a money handling system, and a money handling method according to an embodiment of the present invention will be described with reference to the accompanying drawings. This embodiment will be described mainly for a case where a money handling apparatus such as a money depositing machine for depositing proceeds from sales therein is installed in a store A (hereinafter referred to also as the first store) and proceeds from sales of a store B (hereinafter referred to also as the second store) in which the money handling apparatus is not installed are deposited in the money handling apparatus installed in a store A.

Concept of Money Handling System of Present Embodiment

Figure 1:
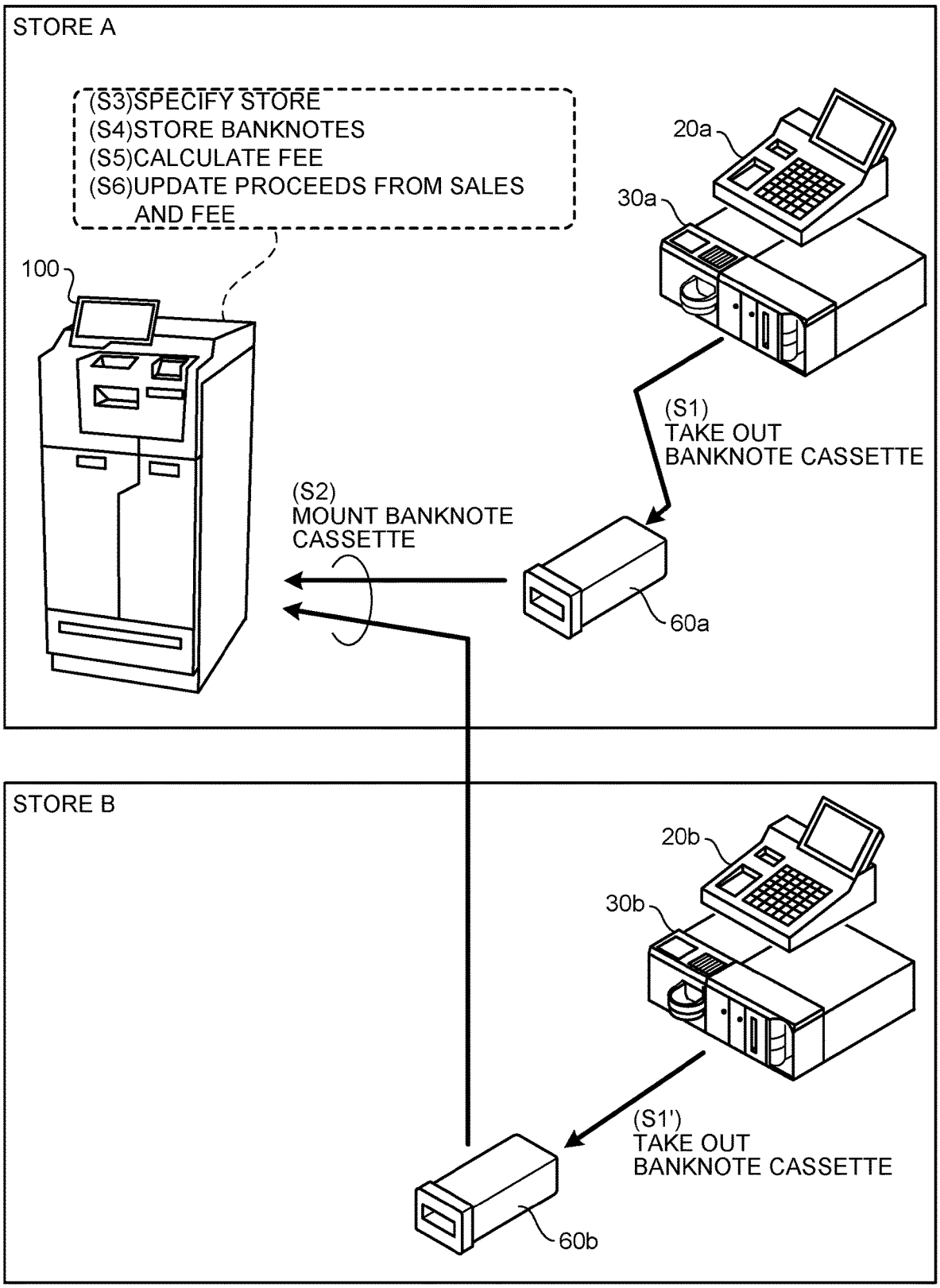
FIG. 1 shows the concept of a money handling system according to the present embodiment.

First, the concept of the money handling system according to the present embodiment will be described. FIG. 1 shows the concept of the money handling system according to the present embodiment.

A POS register 20*a*, a change machine 30*a*, and a money handling apparatus 100 are installed in a store A shown in FIG. 1. Money, as proceeds from sales of the store A, stored in the change machine 30*a* is carried to the money handling apparatus 100 with a container and stored in the money handling apparatus 100. The container is brought by a cashier in the store A. Specifically, banknotes of the proceeds from sales of the store A stored in the change machine 30*a* are carried to the money handling apparatus 100 with a cassette as the container, and the money handling apparatus 100 stores the banknotes therein. Coins of the proceeds from sales of the store A stored in the change machine 30*a* are carried to the money handling apparatus 100 with a bag as the container and the money handling apparatus 100 stores the coins therein. Money stored in the money handling apparatus 100 is collected at a predetermined time by a cash-in-transit (CIT) company and conveyed to a cash center.

Although a POS register 20*b* and a change machine 30*b* are installed in a store B shown in FIG. 1, a money handling apparatus in which money as proceeds from sales of the store B is to be stored may not be installed in the store B. When the store B is a relatively small store, the store B is less likely to introduce a money handling apparatus. For example, money stored in the change machine 30*b* is manually collected by a person in charge (i.e. a cashier) and stored in a safe or the like in the store B. Therefore, money as the proceeds from sales of the store B cannot be managed with efficiency, and a dishonest act may be performed for money as the proceeds from sales of the store B. Money stored in the safe is collected at a predetermined time by the CIT company and conveyed to the cash center.

A dishonest act for the proceeds from sales of the store A is less likely to be performed in a store, such as the store A, in which the money handling apparatus 100 is installed. On the other hand, since the proceeds from sales have to be manually managed in a store, such as the store B, in which the money handling apparatus 100 is not installed, the proceeds from sales cannot be managed efficiently.

Therefore, the money handling system according to the present embodiment is configured such that money as the proceeds from sales of the store B in the change machine 30*b* installed in the store B can be stored in the money handling apparatus of the neighboring store A whose management agency is different from that of the store B. Thus, money as the proceeds from sales of the store B can be managed efficiently. However, the store B pays a usage fee to the store A, in exchange for the management of money as the proceeds from sales of the store B by the money handling apparatus 100 of the store A.

Next, the concept of the present embodiment will be specifically described with reference to FIG. 1. For convenience of description, a case where banknotes are stored in the money handling apparatus 100 will be mainly described below while omitting description for a case where coins are stored in the money handling apparatus 100. In the following description, the POS register 20*a* and the POS register 20*b* shown in FIG. 1 have the same function, and these registers may be simply and collectively referred to as a POS register 20. The change machine 30*a* and the change machine 30*b* have the same function, and these machines may be simply and collectively referred to as a change machine 30. A banknote cassette 60*a* and a banknote cassette 60*b* have the same function, and these cassettes may be simply and collectively referred to as a banknote cassette 60 which is a container carrying money such as banknotes and detachably mounting to the change machine 30.

The POS register 20 shown in FIG. 1 is a cash register having a POS function. The change machine 30 is communicably connected to the POS register 20. The change machine 30 stores therein money that has been received from a customer by a clerk, and dispenses, as change, money corresponding to a difference between the amount of the money received from the customer and the price of a commodity. Banknotes of the money received from the customer as the proceeds from sales are stored in the change machine 30 and are transported to the banknote cassette 60. The banknotes as the proceeds from sales stored in the banknote cassette 60 are carried by the banknote cassette 60. The POS register 20 and the change machine 30 will be described later in detail.

The money handling apparatus 100 is a money depositing machine in which money carried by the banknote cassette 60 from the change machine 30 is stored as the proceeds from sales. Specifically, not only money having been stored in the change machine 30*a* installed in the store A but also money having been stored in the change machine 30*b* installed in the store B are carried by the banknote cassette 60 and stored as proceeds from sales in the money handling apparatus 100.

As shown in FIG. 1, the banknote cassette 60*a* is taken out from the change machine 30*a* in the store A (step S1), and mounted to the money handling apparatus 100 (step S2). The money handling apparatus 100 reads identification information corresponding to the store A as a store ID of the store A from a memory of an IC tag attached to the banknote cassette 60*a*, and specifies a store, proceeds from sales of which are stored in the banknote cassette 60*a* (step S3). The money handling apparatus 100 feeds the banknotes from the banknote cassette 60*a* and stores the banknotes therein (step S4). The money handling apparatus 100 calculates a fee (step S5), and updates information on the proceeds from sales and the fee (step S6). When the banknote cassette 60*a* is mounted thereto, the money handling apparatus 100 specifies that the proceeds from sales of the store A have been stored therein. Therefore, the fee is "0", and information on the proceeds from sales of the store A is updated.

The banknote cassette 60*b* is taken out from the change machine 30*b* in the store B (step S1'), and mounted to the money handling apparatus 100 (step S2). The money handling apparatus 100 reads identification information corresponding to the store B as a store ID of the store B from a memory of an IC tag attached to the banknote cassette 60*b*, and specifies a store, proceeds from sales of which are stored in the banknote cassette 60*b* (step S3). The money handling apparatus 100 feeds the banknotes from the banknote cassette 60*b* and stores the banknotes therein (step S4). The money handling apparatus 100 calculates a fee (step S5), and updates information on the proceeds from sales and the fee (step S6). When the banknote cassette 60*b* is mounted thereto, the money handling apparatus 100 specifies that the proceeds from sales of the store B have been stored. Therefore, a fee to be paid by the store B is calculated, and information on the proceeds from sales of the store B and information on the fee are updated. The fee will be described later in detail.

As described above, in the money handling system according to the present embodiment, the money handling apparatus 100, which is installed in the store A and performs depositing of money as proceeds from sales of the store A, receives money as proceeds from sales of the store B being at least one of other stores different from the store A. The money handling apparatus 100, which has received the money from the store B, determines that the store corresponding to the money is the store B. Upon receiving money from the other stores, the money handling apparatus 100 stores the money therein, and stores information on the proceeds from sales of each store. Thus, in the money handling system, the proceeds from sales of the store, which has not introduced an apparatus for managing the proceeds from sales, can be efficiently managed.

Furthermore, in the money handling system, a fee is set for management of proceeds from sales by using the money handling apparatus 100 of the store A, and the fee can be calculated according to the usage state of the money handling apparatus 100.

<Configurations of POS Register 20 and Change Machine 30>

Figure 2:
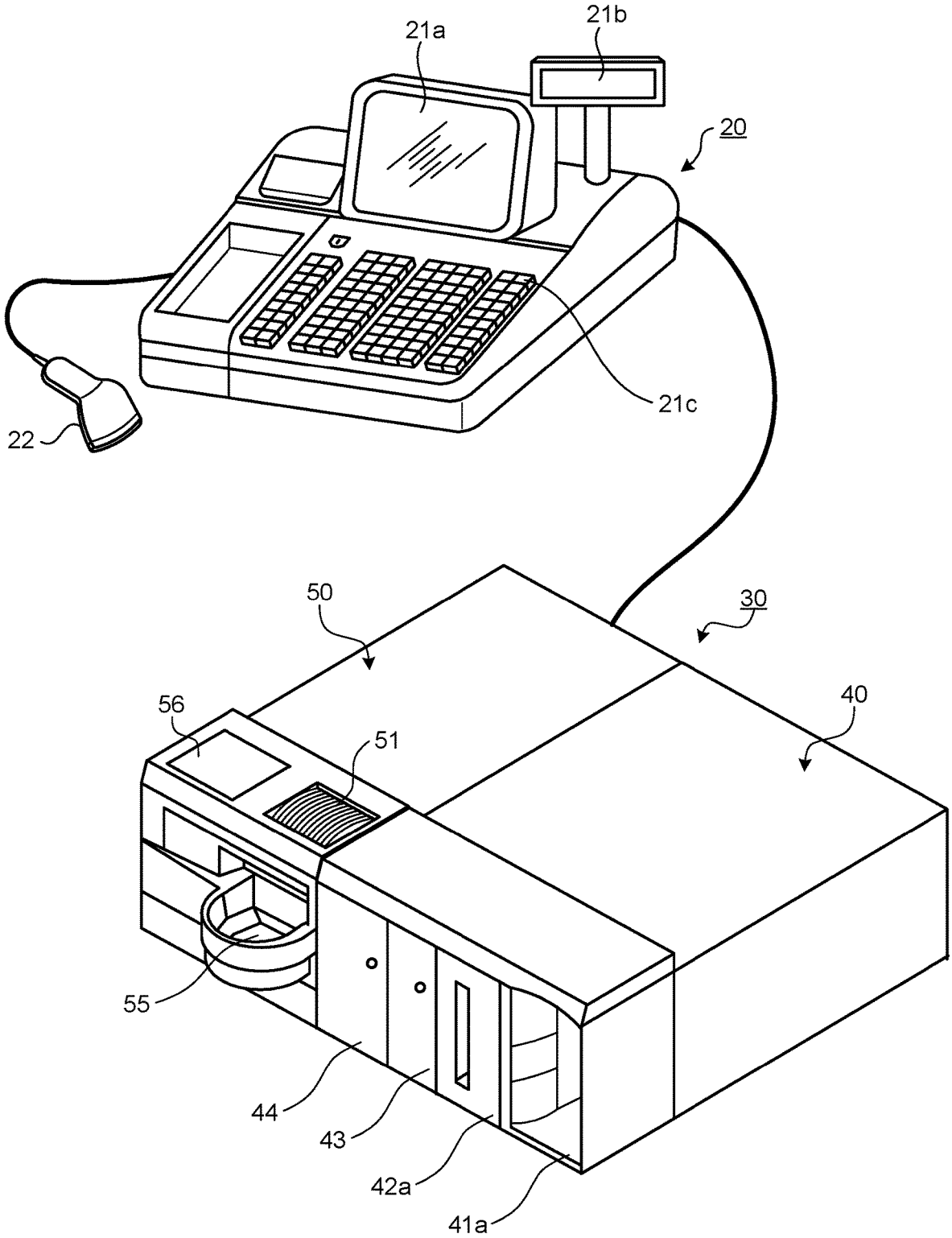
FIG. 2 shows the external configurations of a POS register and a change machine.

The configurations of the POS register 20 and the change machine 30 will be described. FIG. 2 shows the external configurations of the POS register 20 and the change machine 30. As shown in FIG. 2, the POS register 20 includes a display 21*a* for an operator, a display 21*b* for a customer, an operation unit 21*c* such as an operation key, and a barcode reader 22.

The change machine 30 includes a banknote handling unit 40, and a coin handling unit 50. The coin handling unit 50 is disposed adjacent to the banknote handling unit 40. The POS register 20 can be disposed on the banknote handling unit 40 and the coin handling unit 50.

The banknote handling unit 40 performs depositing and dispensing of banknotes. The banknote handling unit 40 includes a banknote inlet 41*a* and a banknote outlet 42*a*. The banknote handling unit 40 further includes a dispensing reject unit 13 and a cassette mounting unit 44 which are described later.

The coin handling unit 50 performs depositing and dispensing of coins. The coin handling unit 50 includes a coin inlet 51 and a coin outlet 55. The coin handling unit 50 further includes an operation/display unit 56 of the change machine 30.

Figure 3:
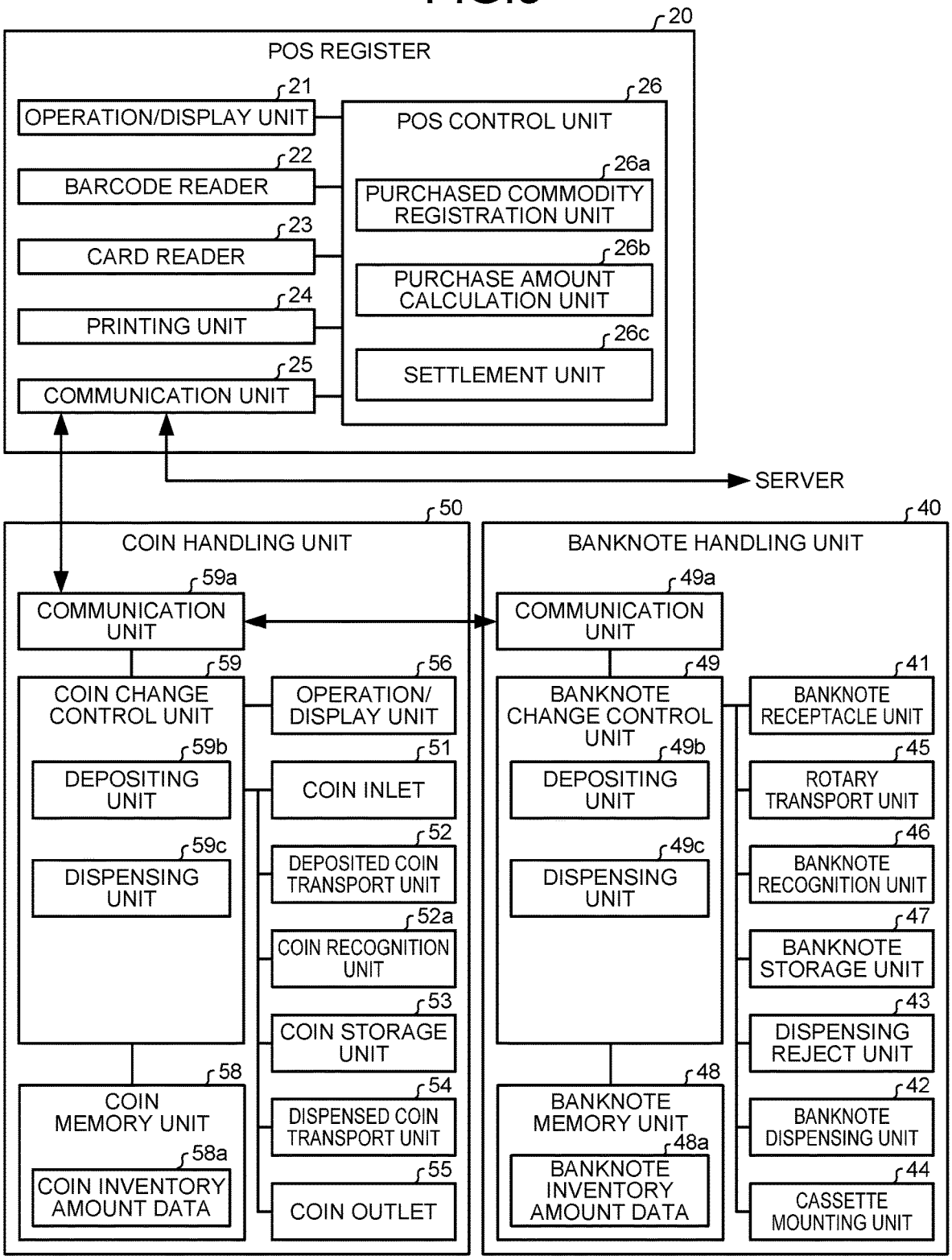
FIG. 3 is a functional block diagram of the POS register and the change machine.

FIG. 3 is a functional block diagram showing the functional configurations of the POS register 20 and the change machine 30. As shown in FIG. 3, the POS register 20 includes an operation/display unit 21, the barcode reader 22, a card reader 23, a printing unit 24, a communication unit 25, and a POS control unit 26.

The operation/display unit 21 outputs information to an operator and a customer by using the display 21*a* and the display 21*b*, and receives an input performed by the operator by using the operation unit 21*c*. The barcode reader 22 reads barcodes attached to commodities. Thus, information such as the names, prices, etc., of the commodities can be obtained. The card reader 23 is used for checkout with a payment card. Examples of the payment card include a credit card, a debit card, and a prepaid card.

The printing unit 24 is used for issuing a receipt on which the content of a transaction is printed. The content of the transaction printed on the receipt includes, for example, date and time, names and prices of registered commodities, an amount of inserted money, and an amount of change. The communication unit 25 is a communication interface for communication with the change machine 30 and an external server.

The POS control unit 26 controls the entirety of the POS register 20. The POS control unit 26 includes a purchased commodity registration unit 26*a*, a purchase amount calculation unit 26*b*, and a settlement unit 26*c*. The purchased commodity registration unit 26*a* performs registration of commodities to be purchased. Specifically, when the barcode reader 22 has read a barcode attached to a commodity to obtain information such as the name, price, etc., of the commodity, the purchased commodity registration unit 26*a* performs registration of the commodity by using the obtained information. The purchased commodity registration unit 26*a* displays information on the registered commodity on the display 21*a* or the like.

The purchase amount calculation unit 26*b* calculates a purchase amount by adding up the prices of all the commodities registered by the purchased commodity registration unit 26*a*. The purchase amount calculation unit 26*b* displays the calculated purchase amount on the display 21*a* or the like.

The settlement unit 26*c* performs settlement of the purchase amount calculated by the purchase amount calculation unit 26*b*. Upon completion of the transaction, the settlement unit 26*c* issues a receipt. The settlement of the purchase amount may be performed by using a payment card or cash.

Specifically, when settlement using a payment card is selected, the settlement unit 26*c* obtains information such as the card ID from the payment card inserted in the card reader 23, and transmits the information together with the purchase amount to an external server, thereby performing the settlement.

When settlement by cash is selected, the settlement unit 26*c* transmits the purchase amount to the change machine 30, and completes the settlement upon receiving checkout completion notification from the change machine 30.

The change machine 30 includes the banknote handling unit 40 and the coin handling unit 50. The banknote handling unit 40 stores therein banknotes for each denomination. The coin handling unit 50 stores therein coins for each denomination.

The banknote handling unit 40 includes a communication unit 49*a*, a banknote receptacle unit 41, a rotary transport unit 45, a banknote recognition unit 46, a banknote storage unit 47, a dispensing reject unit 43, a banknote dispensing unit 42, a cassette mounting unit 44, a banknote memory unit 48, and a banknote change control unit 49. The communication unit 49*a* is an interface for data communication with the coin handling unit 50 via a communication line. The banknote handling unit 40 is not connected to the POS register 20 directly by a communication line, but can communicate with the POS register 20 via the coin handling unit 50.

The banknote memory unit 48 is a storage device realized by, for example, a memory such as a flash memory, or a secondary storage medium such as a hard disk drive. The banknote memory unit 48 stores therein banknote inventory amount data 48*a*, etc. The banknote inventory amount data

48*a* indicates the inventory amounts, for each denomination, of the banknotes stored in the banknote handling unit 40.

The banknote change control unit 49 controls the banknote handling unit 40. The banknote change control unit 49 includes a depositing unit 49*b* and a dispensing unit 49*c*.

The depositing unit 49*b* performs depositing of banknotes. The depositing unit 49*b* allows insertion of banknotes to the banknote handling unit 40 when receiving a purchase amount from the POS register 20.

The depositing unit 49*b* obtains the number of banknotes, for each denomination, inserted into the banknote handling unit 40, and calculates the total amount of the inserted banknotes. The total amount of the banknotes is notified to the POS register 20 via the communication unit 59*a* of the coin handling unit 50.

The dispensing unit 49*c* performs dispensing of banknotes. Upon receiving a change dispensing instruction from the POS register 20 via the communication unit 59*a* of the coin handling unit 50, the dispensing unit 49*c* determines the denominations and the number of banknotes to be dispensed in accordance with the amount of change, and dispenses banknotes. When dispensing of the change is successfully completed, the completion is notified to the POS register 20 via the communication unit 59*a* of the coin handling unit 50.

The coin handling unit 50 includes the communication unit 59*a*, the coin inlet 51, a deposited coin transport unit 52, a coin recognition unit 52*a*, a coin storage unit 53, a dispensed coin transport unit 54, the coin outlet 55, the operation/display unit 56, a coin memory unit 58, and a coin change control unit 59. The communication unit 59*a* is an interface for data communication with the POS register 20 and the banknote handling unit 40 via a communication line.

The coin memory unit 58 is a storage device realized by, for example, a memory such as a flash memory, or a secondary storage medium such as a hard disk drive. The coin memory unit 58 stores therein coin inventory amount data 58*a*, etc. The coin inventory amount data 58*a* indicates the inventory amounts, for each denomination, of the coins stored in the coin handling unit 50.

The coin change control unit 59 controls the coin handling unit 50. The coin change control unit 59 includes a depositing unit 59*b* and a dispensing unit 59*c*.

The depositing unit 59*b* performs depositing of coins. The depositing unit 59*b* allows insertion of coins into the coin handling unit 50 when receiving a purchase amount from the POS register 20.

Thereafter, the depositing unit 59*b* obtains the number of coins, for each denomination, inserted into the coin handling unit 50, and calculates the total amount of the inserted coins. The total amount of the coins is notified to the POS register 20.

The dispensing unit 59*c* performs dispensing of coins. Upon receiving a change dispensing instruction from the POS register 20, the dispensing unit 59*c* determines the denominations and the number of coins to be dispensed, in accordance with the amount of change, and dispenses the coins. When dispensing of the change is successfully completed, the completion is notified to the POS register 20.

Figure 4:
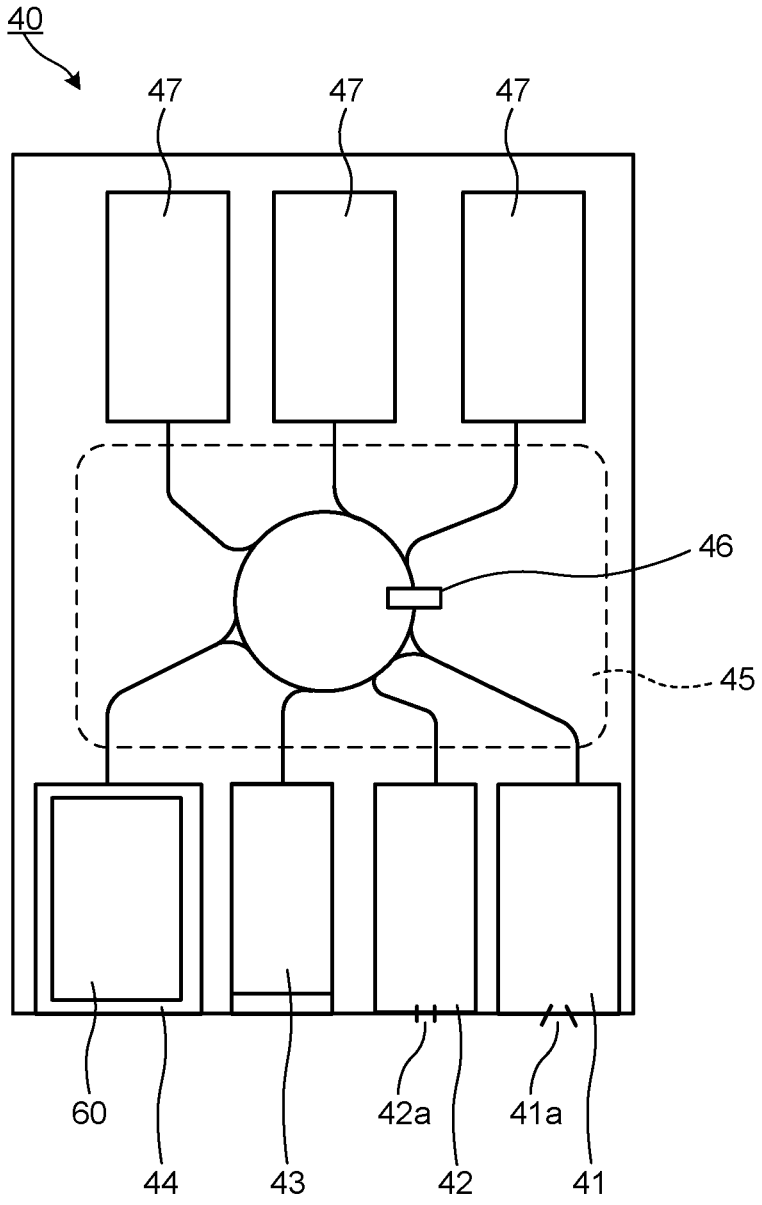
FIG. 4 shows the configuration of a banknote handling unit.

Next, the banknote handling unit 40 and the coin handling unit 50 will be described in detail. FIG. 4 shows the configuration of the banknote handling unit 40. As shown in FIG. 4, the banknote handling unit 40 includes the banknote receptacle unit 41, the banknote dispensing unit 42, the dispensing reject unit 43, the cassette mounting unit 44, the rotary transport unit 45, the banknote recognition unit 46, and the denomination-specific banknote storage units 47.

The banknote receptacle unit 41 receives banknotes inserted through the banknote inlet 41*a*, and feeds out the received banknotes one by one to the rotary transport unit 45. The banknote dispensing unit 42 temporarily stores therein the banknotes transported one by one from the rotary transport unit 45. The banknote dispensing unit 42, when all the banknotes to be dispensed are stored therein, dispenses the banknotes by discharging the banknotes from the banknote outlet 42*a*.

The dispensing reject unit 43 accumulates therein a banknote that is not suitable to be dispensed, such as a banknote whose denomination cannot be recognized. For example, among the banknotes having been fed out from the banknote storage unit 47 during dispensing, a banknote, which could not be recognized by the banknote recognition unit 46 because of abnormal transport such as overlapping or skew, is transported to the dispensing reject unit 43. Meanwhile, among the banknotes having been taken into the machine from the banknote receptacle unit 41 during depositing, a banknote, which could not be recognized by the banknote recognition unit 46 because of stain or the like, is returned as a deposit rejected banknote to the banknote dispensing unit 42.

The cassette mounting unit 44 is configured such that a banknote cassette 60, which is used for collection of proceeds from sales and replenishment of change, is detachably mounted thereto.

The plurality of banknote storage units 47 are assigned corresponding denominations. Each banknote storage unit 47 stores therein banknotes of the assigned denomination one by one, and can feed out the stored banknotes one by one.

The rotary transport unit 45 includes a rotary transport path in the center thereof. A connection/transport path is disposed between the rotary transport path and each of the banknote receptacle unit 41, the banknote dispensing unit 42, the dispensing reject unit 43, the cassette mounting unit 44, and the plurality of banknote storage units 47. The rotary transport path is provided with the banknote recognition unit 46 which preforms recognition of banknotes. The banknote recognition unit 46 recognizes, for example, the denomination, authenticity, fitness, face/back, and transport state of each banknote.

The rotary transport unit 45 drives the rotary transport path to rotate in both the clockwise direction and the counterclockwise direction in FIG. 4. The rotary transport path being rotated allows banknotes to be transported one by one. Specifically, when storing banknotes in the banknote storage unit 47, the rotary transport unit 45 drives the rotary transport path to rotate clockwise in FIG. 4. When feeding out banknotes from the banknote storage unit 47, the rotary transport unit 45 drives the rotary transport path to rotate counterclockwise in FIG. 4. In addition to the rotation drive control, the rotary transport unit 45 controls the transport destination of each banknote by switching the banknote transport routes between the rotary transport path and the respective connection/transport paths.

Figure 5:
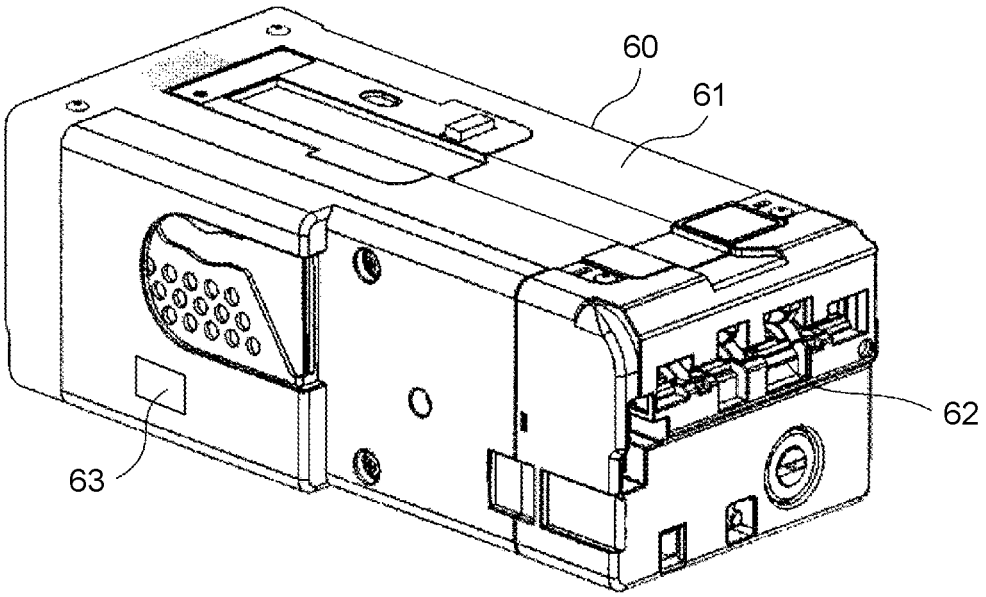
FIG. 5 is a perspective view showing the appearance of a banknote cassette.

FIG. 5 is a perspective view showing the appearance of the banknote cassette 60. As shown in FIG. 5, the banknote cassette 60 has a casing 61 having a substantially rectangular parallelepiped shape. Inside the casing 61, banknotes are stored in a stacked state. As described above, the banknote cassette 60 can be detachably mounted to the mounting unit disposed in the money handling apparatus 100 and the mounting unit disposed in the change machine 30.

An opening 62 is formed on the side surface of the casing 61 of the banknote cassette 60. The money handling apparatus 100 and the change machine 30 can send banknotes into the banknote cassette 60 via the opening 62 of the banknote cassette 60 mounted thereto. The money handling apparatus 100 and the change machine 30 can feed out the banknotes stored in the banknote cassette 60 through the opening 62, and store the banknotes fed from the banknote cassette 60 therein.

More specifically, a banknote feeding mechanism is disposed inside the banknote cassette 60. The banknote feeding mechanism feeds the banknotes stored in the banknote cassette 60 to the outside of the casing 61 through the opening 62. Each of the money handling apparatus 100 and the change machine 30, when the banknote cassette 60 is mounted thereto, transmits power to the banknote feeding mechanism of the banknote cassette 60.

In the state where the banknote cassette 60 is taken out from the money handling apparatus 100 and the change machine 30, the banknotes stored in the banknote cassette 60 cannot be fed to the outside of the casing 61. Thus, security of the banknotes stored in the banknote cassette 60 can be enhanced.

An IC tag 63 is disposed at a side surface of the casing 61 of the banknote cassette 60. The IC tag 63 of a RFID (Radio Frequency identifier) serves as a memory for the cassette. Each of the money handling apparatus 100 and the change machine 30 is provided with a reader/writer. The money handling apparatus 100 and the change machine 30, when the banknote cassette 60 is mounted thereto, can write various data into the memory of the IC tag 63 and read various data from the memory of the IC tag 63 through the reader/writer.

FIG. 6 shows specific examples of data stored in the IC tag 63. As shown in FIG. 6, information stored in the IC tag 63 includes: a cassette ID as identification information of the banknote cassette 60; a store ID and a cash register ID specifying a store and a cash register, respectively, that use the banknote cassette 60; fee setting; and the amount of stored money.

In the example shown in FIG. 6, the cassette ID is "C009", the store ID is "U002", the cash register ID is "R001", the fee setting is "amount of stored money×0.02", and the amount of stored money is "427,000 yen". In addition, the IC tag 63 may store therein, for example, the number of stored banknotes for each denomination. In FIG. 6, as for the fee setting, a fee is calculated based on the amount of stored money and the fee rate, but a predetermined basic fee (e.g., 200 yen per storage) may be imposed each time money is stored in the money handling apparatus 100.

Figure 7:
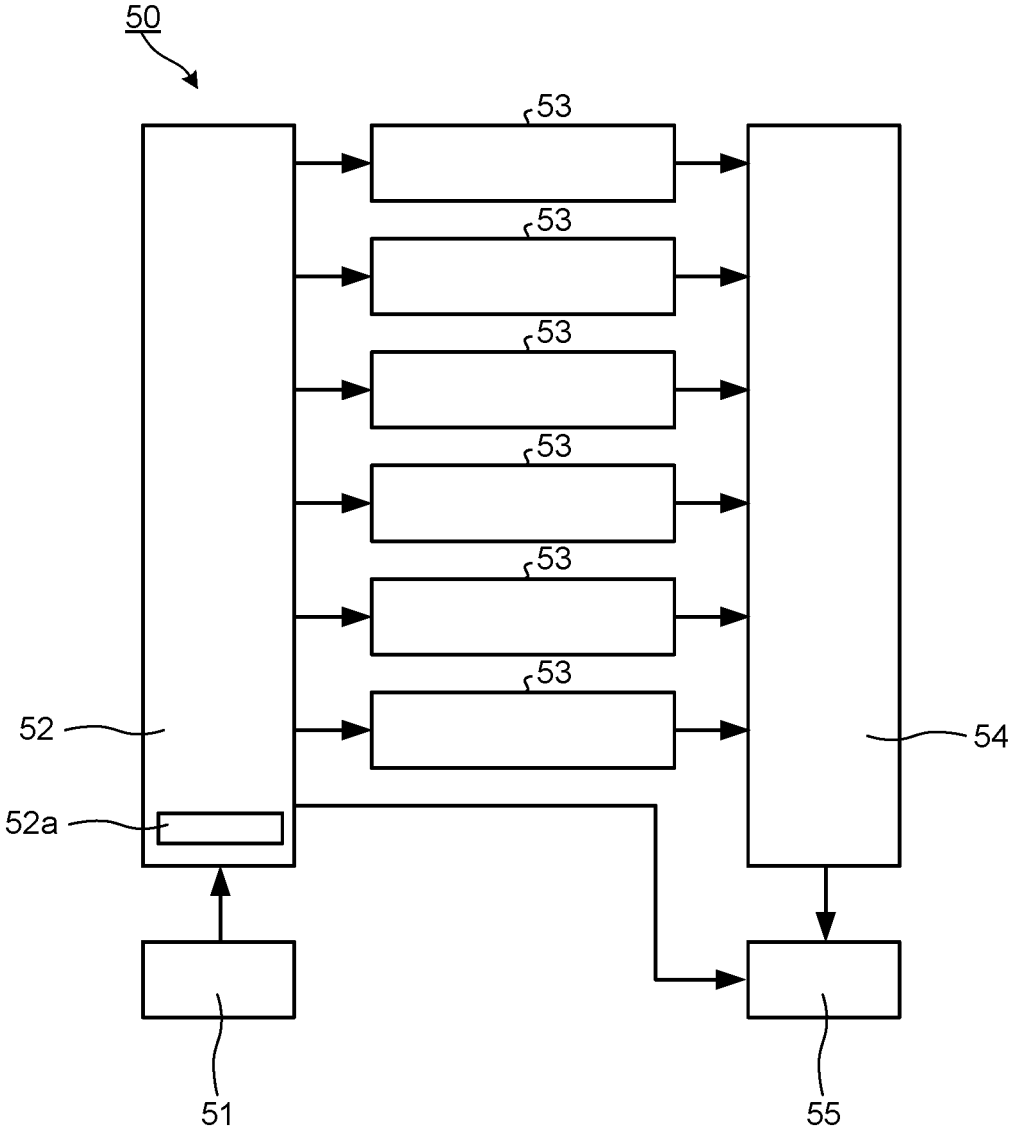
FIG. 7 shows the configuration of a coin handling unit.

FIG. 7 shows the configuration of the coin handling unit 50. As shown in FIG. 7, the coin handling unit 50 includes the coin inlet 51, the deposited coin transport unit 52, the denomination-specific coin storage units 53, the dispensed coin transport unit 54, and the coin outlet 55. The deposited coin transport unit 52 is provided with the coin recognition unit 52*a*.

The deposited coin transport unit 52 takes coins inserted through the coin inlet 51, one by one, into a housing such that the coins are arranged in one layer in one line. The deposited coin transport unit 52 is provided with a coin feeding mechanism including a feed belt. When insertion of coins through the coin inlet 51 is detected, the coin feeding mechanism is driven, and the coins are fed out one by one.

The coin recognition unit 52*a* performs recognition of the coins fed out into the deposited coin transport unit 52. The coin recognition unit 52*a* recognizes, for example, the denomination, authenticity, fitness, face/back, and transport state of each coin. The deposited coin transport unit 52 determines a transport destination of each coin on the basis of the recognition result of the coin recognition unit 52*a*. A coin not suitable to be stored in the coin storage unit 53, such as a stained coin or a coin not recognized as a genuine coin, is transported to the coin outlet 55 as a rejected coin. A coin suitable to be stored in the coin storage unit 53 is transported to the coin storage unit 53 corresponding to the recognition result of the denomination.

The plurality of coin storage units 53 are assigned corresponding denominations. Each coin storage unit 53 stores therein coins of the assigned denomination, and can feed out the stored coins one by one to the dispensed coin transport unit 54. The dispensed coin transport unit 54 transports the coins fed from the coin storage unit 53, and dispenses the coins to the coin outlet 55.

<Configuration of Money Handling Apparatus>

Figure 8:
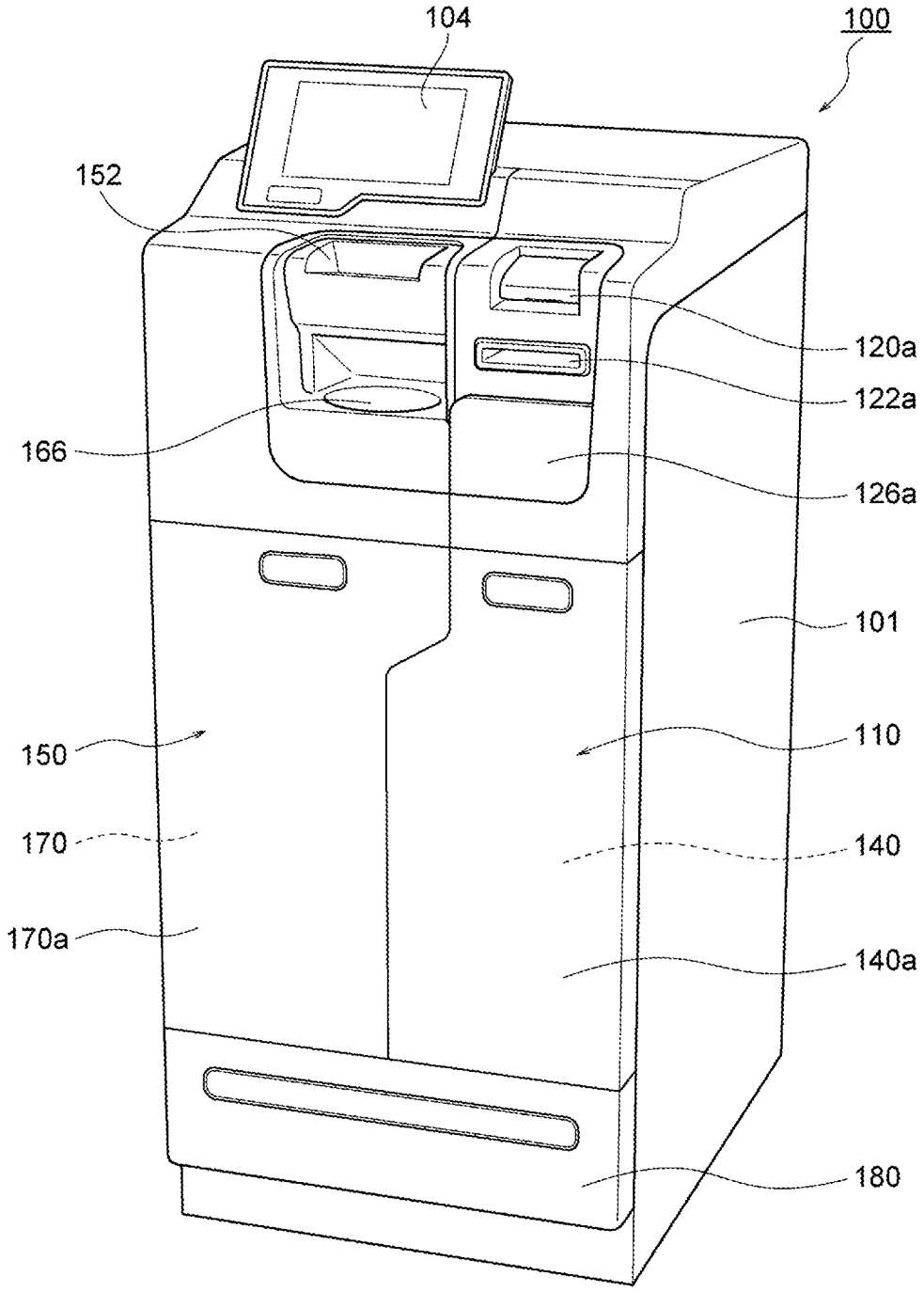
FIG. 8 is a perspective view showing the appearance of a money handling apparatus.

The configuration of the money handling apparatus 100 will be described with reference to FIG. 8 to FIG. 12. As shown in FIG. 8, etc., the money handling apparatus 100 according to the present embodiment includes a housing 101 having a substantially rectangular parallelepiped shape. Inside the housing 101, a banknote handling unit 110 which performs depositing and dispensing of banknotes, a coin handling unit 150 which performs depositing and dispensing of coins, and a coin roll storage unit 180 which stores therein coin rolls, are accommodated. A coin roll is obtained by collecting a predetermined number (e.g., 20 or 50) of coins of the same denomination into a roll, and wrapping the roll with a film or a wrapping paper. As shown in FIG. 8, the banknote handling unit 110 and the coin handling unit 150 are aligned in the left-right direction as viewed from the front side of the money handling apparatus 100. The coin roll storage unit 180 is disposed below the banknote handling unit 110 and the coin handling unit 150.

Figure 9:
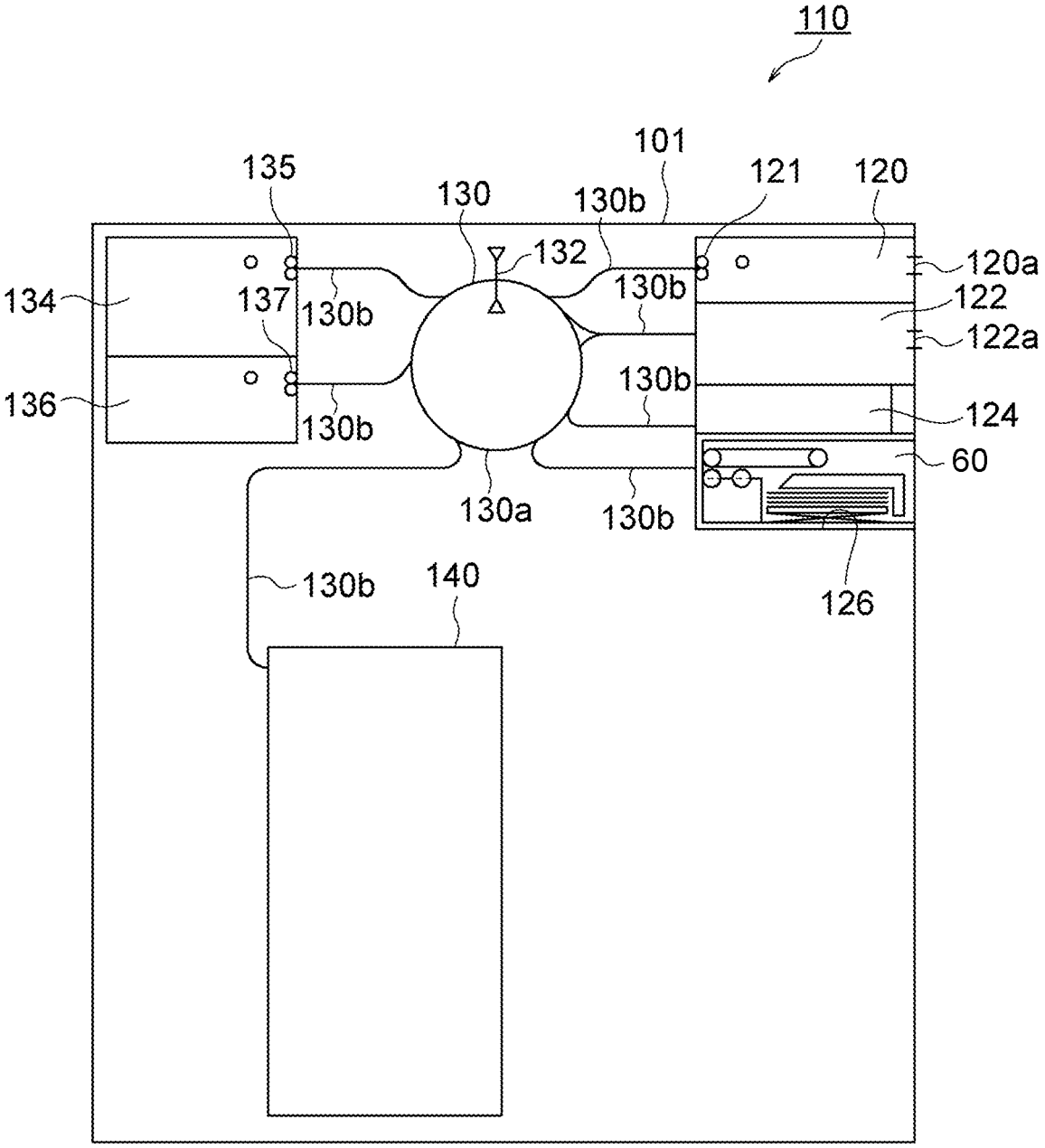
FIG. 9 shows the internal configuration of a banknote handling unit shown in FIG. 8.

As shown in FIG. 8 and FIG. 9, the banknote handling unit 110 includes a banknote receptacle unit 120, a banknote dispensing unit 122, a transport unit 130, and banknote storage units 134 and 136. The banknote receptacle unit 120 is disposed in a right side region on the front surface side of the housing 101. The banknote dispensing unit 122 is disposed below the banknote receptacle unit 120 on the front surface side of the housing 101. The transport unit 130 transports banknotes one by one in the housing 101. Each of the banknote storage units 134 and 136 stores banknotes in the housing 101, and can feed out the banknotes stored therein. In FIG. 9, the right side surface of the housing 101 corresponds to the surface on the front side of the banknote handling unit 110, and the leftward direction in FIG. 9 corresponds to the depth direction of the banknote handling unit 110.

As shown in FIG. 9, the transport unit 130 includes a rotary transport unit 130*a* disposed at the center position in the upper portion of the housing 101, and a plurality of connection/transport units 130*b*. The banknote receptacle unit 120, the banknote dispensing unit 122, a reject unit 124, a cassette mounting unit 126 which allows the banknote cassette 60 to be detachably mounted, a collection cassette 140, and the two banknote storage units 134 and 136 are disposed so as to surround the rotary transport unit 130*a*.

As shown in FIG. 9, the plurality of connection/transport units 130*b* allow connection between the rotary transport unit 130*a* and each of the banknote receptacle unit 120, the banknote dispensing unit 122, the reject unit 124, the cassette mounting unit 126, the collection cassette 140, and the two banknote storage units 134 and 136. A recognition unit 132 is disposed at the rotary transport unit 130*a*. The recognition unit 132 performs recognition of the banknotes transported by the rotary transport unit 130*a*. The recognition unit 132 recognizes, for example, the denomination, authenticity, fitness, face/back, and transport state of each banknote.

The rotary transport unit 130*a* can transport banknotes one by one in both the clockwise direction and the counterclockwise direction in FIG. 9. In the transport unit 130, a route switching unit (not shown), which switches the banknote transport routes between the rotary transport unit 130*a* and the respective connection/transport units 130*b*, is disposed along the rotary transport unit 130*a*.

As shown in FIG. 8 and FIG. 9, at the front surface of the housing 101, a banknote inlet 120*a* of the banknote receptacle unit 120 and a banknote outlet 122*a* of the banknote dispensing unit 122 are disposed. A door 126*a* is disposed on the front surface side of the cassette mounting unit 126. With the door 126*a* being opened, the banknote cassette 60 can be mounted to the cassette mounting unit 126, and the banknote cassette 60 can be taken out from the cassette mounting unit 126.

Figure 11:
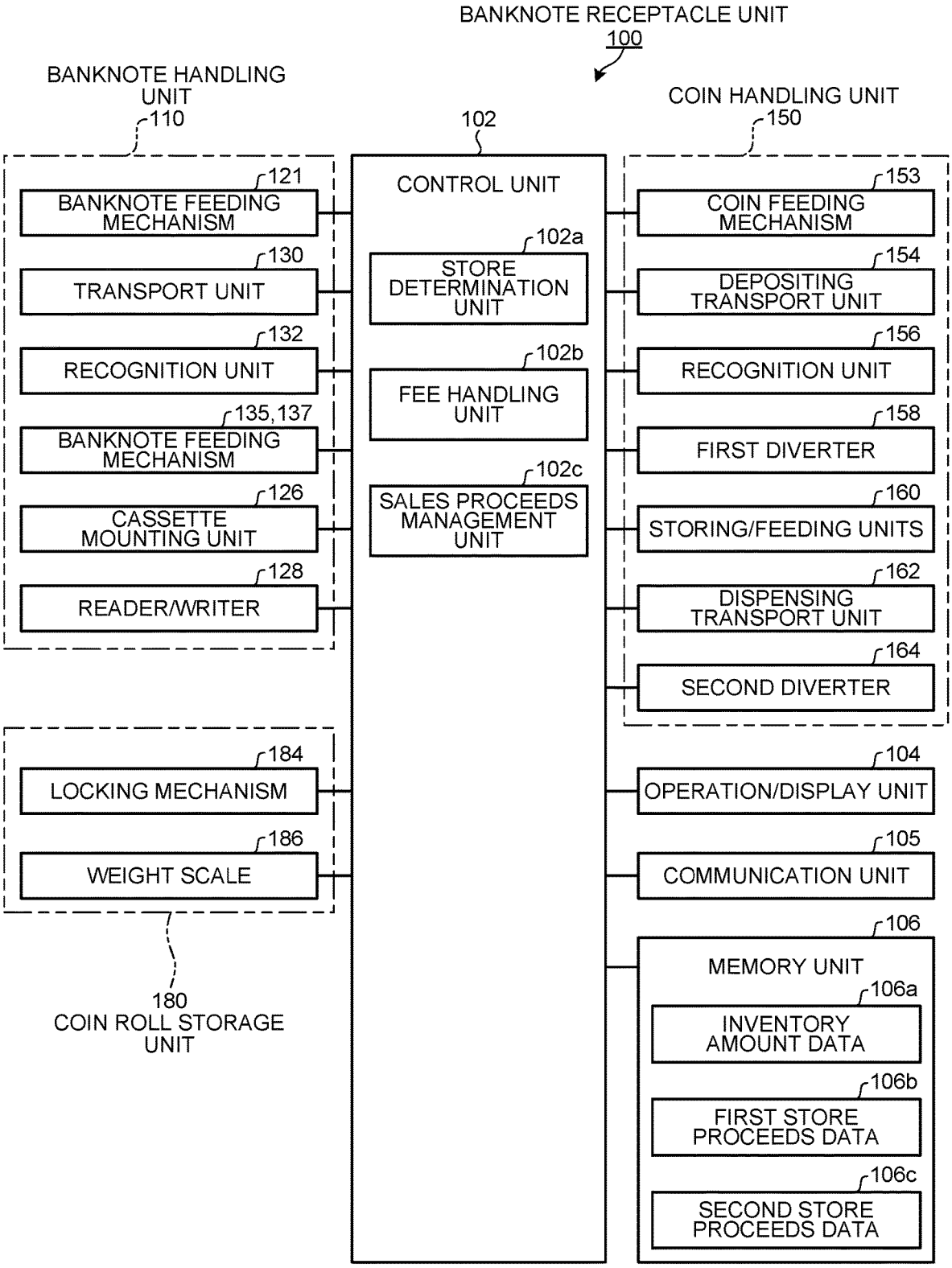
FIG. 11 is a functional block diagram of the money handling apparatus shown in FIG. 8.

The cassette mounting unit 126 is provided with a reader/writer 128 which writes various data into the IC tag 63 attached to the banknote cassette 60 mounted to the cassette mounting unit 126, and reads various data from the IC tag 63. The reader/writer 128 is shown in FIG. 11.

The banknote receptacle unit 120 is provided with a banknote feeding mechanism 121. When insertion of one or a plurality of banknotes in the banknote inlet 120*a* has been detected, the banknote feeding mechanism 121 is driven. Thus, the banknotes in the banknote receptacle unit 120 are fed out one by one through the connection/transport unit 130*b* to the rotary transport unit 130*a*.

The banknote dispensing unit 122 receives banknotes fed out from the banknote storage units 134 and 136 to the rotary transport unit 130*a*, and discharges the banknotes through the banknote outlet 122*a* to the outside of the housing 101.

Among the banknotes having been fed out from the banknote storage units 134 and 136 during dispensing, the reject unit 124 stores therein, as a dispense rejected banknote, a banknote which could not be recognized by the recognition unit 132 because of abnormal transport such as overlapping or skew. Meanwhile, among the banknotes having been taken into the housing 101 from the banknote receptacle unit 120 during depositing, a banknote, which could not be recognized by the recognition unit 132 because of stain or the like, is returned as a deposit rejected banknote to the banknote dispensing unit 122.

Based on the recognition result of the recognition unit 132, the banknote storage units 134 and 136 store therein banknotes of different denominations. In the banknote storage units 134 and 136, banknotes, which are dispensed from the money handling apparatus 100 as change funds to be used in the change machine 30, are stored. For example, 1,000-yen notes are stored in the banknote storage unit 134, and 5,000-yen notes are stored in the banknote memory unit 136. Meanwhile, 10,000-yen notes are stored in a collection cassette 140 described later. The banknote storage units 134 and 136 are provided with banknote feeding mechanisms 135 and 137, respectively. The banknotes stored in the banknote storage units 134 and 136 are fed out one by one through the connection/transport units 130*b* to the rotary transport unit 130*a* by the banknote feeding mechanisms 135 and 137, respectively.

In a lower region inside the housing 101, the collection cassette 140 is accommodated. Banknotes to be collected by the CIT company are stored in the collection cassette 140. Specifically, a banknote recognized by the recognition unit 132 is transported from the rotary transport unit 130*a* through the connection/transport unit 130*b* to the collection cassette 140. A door 140*a* is disposed on the front surface side of the collection cassette 140. With the door 140*a* being opened, the collection cassette 140 can be housed in the housing 101, or the collection cassette 140 can be taken out from the housing 101.

Figure 10:
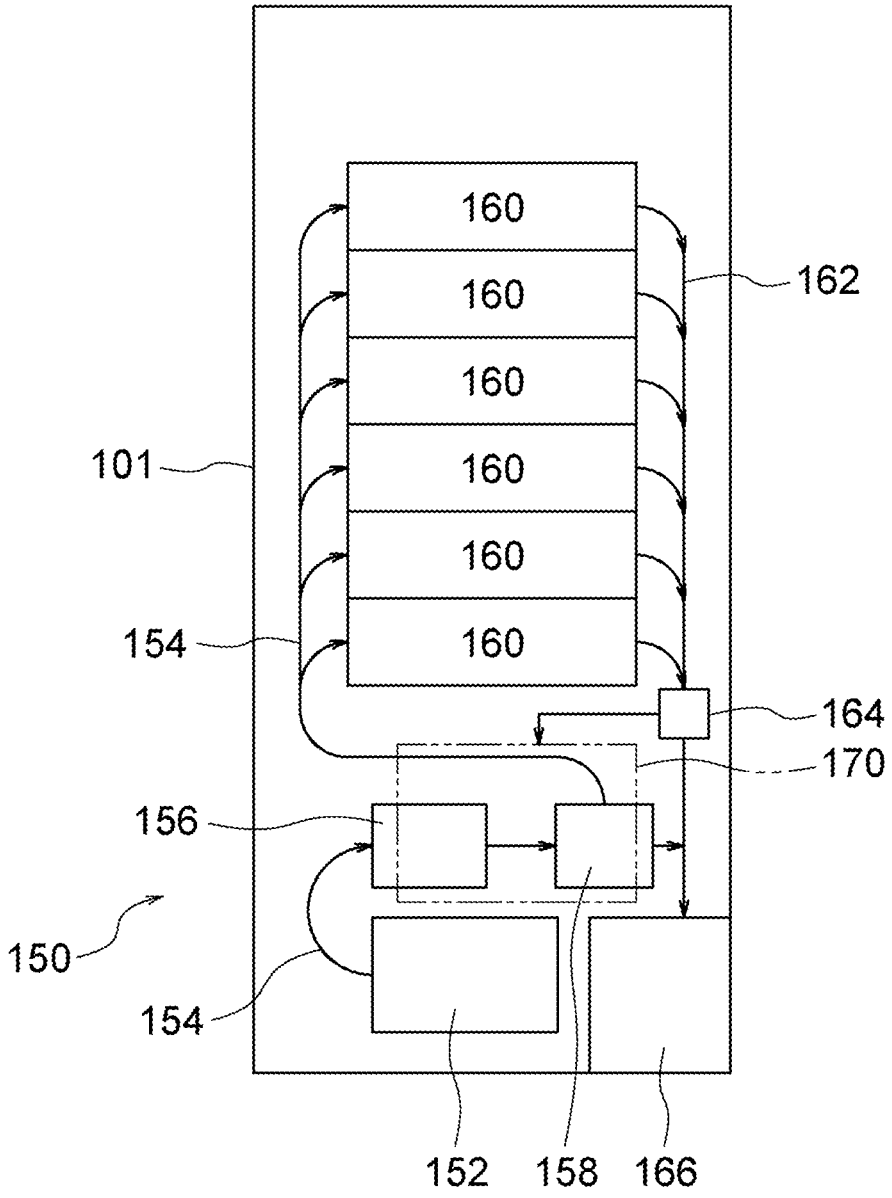
FIG. 10 shows the internal configuration of a coin handling unit shown in FIG. 8.

Next, the configuration of the coin handling unit 150 will be described. As shown in FIG. 8 and FIG. 10, the coin handling unit 150 includes a coin receptacle unit 152, a coin dispensing unit 166, and a plurality of storing/feeding units 160. The coin receptacle unit 152 disposed in a left side region on the front surface side of the housing 101. The coin dispensing unit 166 is disposed below the coin receptacle unit 152 on the front surface side of the housing 101. The respective storing/feeding units 160 store coins inside the housing 101, and can feed out the coins stored therein.

The coin receptacle unit 152 takes coins received through the coin inlet, one by one, into the housing 101 such that the coins are arranged in one layer in one line. Specifically, the coin receptacle unit 152 is provided with a coin feeding mechanism 153 (see FIG. 11) including a feed belt. When the coins received by the coin receptacle unit 152 are detected, the coin feeding mechanism 153 is driven. The coins are fed out one by one into the housing 101 by the coin feeding mechanism 153. As shown in FIG. 10, a depositing transport unit 154, which transports the coins fed out into the housing 101 by the coin receptacle unit 152, is connected to the coin receptacle unit 152.

As shown in FIG. 10, in the depositing transport unit 154, a recognition unit 156 and a first diverter 158 are disposed. The recognition unit 156 recognizes, for example, the denomination, authenticity, fitness, face/back, and transport state of each coin. The first diverter 158 diverges a coin (such as a rejected coin) to be dispensed from the coin dispensing unit 166, from the depositing transport unit 154 on the basis of a coin recognition result by the recognition unit 156, and guides the coin to a dispensing transport unit 162.

Meanwhile, coins (such as normal coins) to be stored in the housing 101 are transported to the respective storing/feeding units 160 by the depositing transport unit 154. The storing/feeding units 160 stores the coins for each denomination, and can feed out the coins stored therein. For example, six storing/feeding units 160 are disposed so as to correspond to six denominations of coins (500-yen coin, 100-yen coin, 50-yen coin, 10-yen coin, 5-yen coin, and 1-yen coin) that circulate in Japan. The coins are stored for each denomination in the storing/feeding units 160 from the upstream side of the depositing transport unit 154 (i.e., from the lower side in FIG. 10) in order from the smallest denomination coin. Each storing/feeding unit 160 is provided with a coin feeding mechanism 153 (see FIG. 11) which feeds out, one by one, the coins stored therein to the dispensing transport unit 162.

The dispensing transport unit 162 transports the coins fed out from the storing/feeding units 160 to the coin dispensing unit 166. The dispensing transport unit 162 also transports a rejected coin, which has been diverged from the depositing transport unit 154 by the first diverter 158, to the coin dispensing unit 166.

In a lower region inside the housing 101, the collection cassette 170 is accommodated. Coins to be collected by the CIT company are stored in the collection cassette 170. Specifically, as shown in FIG. 10, a second diverter 164 is disposed on the halfway of the dispensing transport unit 162. A coin diverged from the dispensing transport unit 162 by the second diverter 164 is transported to the collection cassette 170, and stored in the collection cassette 170. A door 170*a* is disposed on the front surface side of the collection cassette 170. With the door 170*a* being opened, the collection cassette 170 can be housed in the housing 101, and the collection cassette 170 can be taken out from the housing 101.

<Configuration of Control System of Money Handling Apparatus>

The configuration of a control system of the money handling apparatus 100 which installed in the store A as the main store will be described. FIG. 11 is a block diagram showing the configuration of the control system of the money handling apparatus 100. A control unit 102 shown in FIG. 11 is disposed inside the housing 101 of the money handling apparatus 100. The control unit 102 controls components of the banknote handling unit 110, the coin handling unit 150, and the coin roll storage unit 180.

The banknote feeding mechanism 121, the transport unit 130, the recognition unit 132, the banknote feeding mechanisms 135 and 137, the cassette mounting unit 126, and the reader/writer 128, which are included in the banknote handling unit 110, are connected to the control unit 102. Banknote recognition information obtained by the recognition unit 132, and data read by the reader/writer 128 from the IC tag 63 attached to the banknote cassette 60 are transmitted to the control unit 102. The control unit 102 transmits an instruction signal to each of the components of the banknote handling unit 110. Thus, the control unit 102 can control these components.

The coin feeding mechanism 153, the depositing transport unit 154, the recognition unit 156, the first diverter 158, the storing/feeding units 160, the dispensing transport unit 162, and the second diverter 164, which are included in the coin handling unit 150, are connected to the control unit 102. Coin recognition information obtained by the recognition unit 156 is transmitted to the control unit 102. The control unit 102 transmits an instruction signal to each of the components of the coin handling unit 150. Thus, the control unit 102 can control these components.

A locking mechanism 184 and a weight scale 186 of the coin roll storage unit 180 are connected to the control unit 102. The result of measurement of coin rolls by the weight scale 186 is transmitted to the control unit 102. The control unit 102 controls the locking mechanism 184 by transmitting an instruction signal to the locking mechanism 184.

The locking mechanism 184 locks a drawer unit of the coin roll storage unit 180 in the housing 101. In the state where the drawer unit is locked in the housing 101 by the locking mechanism 184, the drawer unit cannot be drawn forward from the housing 101, and thus storage and takeout of the coin rolls are restricted. The weight scale 186 measures the weight of the coin rolls stored in the coin roll storage unit 180. Based on the weight of the coin rolls measured by the weight scale 186, the control unit 102 detects the number of the coin rolls stored in the coin roll storage unit 180.

As shown in FIG. 11, an operation/display unit 104, a communication unit 105, and a memory unit 106 are connected to the control unit 102. The operation display unit 104 is, for example, a touch panel disposed at an upper portion of the housing 101. An operation screen to be operated by an operator, and information on an inventory amount of money stored in each of the banknote handling unit 110, the coin handling unit 150, and the coin roll storage unit 180, are displayed on the operation/display unit 104. The operator can input various instructions to the control unit 102 by touching an operation button on the operation screen of the operation/display unit 104 with his/her finger. The communication unit 105 can transmit/receive signals to/from various devices installed inside and outside the store.

The memory unit 106 is a memory device such as a memory. The memory unit 106 stores therein inventory amount data 106*a*, first store proceeds data 106*b* related to the proceeds from sales in the first store (store A), and second store proceeds data 106*c* related to the proceeds from sales in the second store (store B). The inventory amount data 106*a* includes information indicating an inventory amount of money stored in each of the banknote handling unit 110, the coin handling unit 150, the coin roll storage unit 180, the collection cassette 140, and the collection cassette 170. The first store proceeds data 106*b* is data for managing proceeds from sales of the first store (i.e., the store in which the money handling apparatus 100 is installed) on the basis of the proceeds from sales collected from the change machine 30 installed in the first store. The first store proceeds data 106*b* includes the store ID of the first store, and data regarding the proceeds from sales of the first store. The second store proceeds data 106*c* is data for managing proceeds from sales of the second store on the basis of the proceeds from sales collected from the change machine 30 installed in the second store. The second store proceeds data 106*c* includes the store ID of the second store, data regarding the proceeds from sales of the second store, and data indicating a fee calculated for the second store. In the case where the money handling apparatus 100 manages the proceeds from sales of a plurality of other stores, the additional proceeds data (e.g. the third store proceeds data 106*d*) is generated and managed for each of the other stores.

The control unit 102 includes a store determination unit 102*a*, a fee handling unit 102*b*, and a sales proceeds management unit 102*c*.

When the banknote cassette 60 is mounted to the money handling apparatus 100, the store determination unit 102*a* determines a store corresponding to the money stored in the banknote cassette 60, on the basis of the store ID stored in the IC tag 63. Specifically, when the store ID stored in the IC tag 63 matches the store ID in the first store proceeds data 106*b*, the determination result is "first store". When the store ID stored in the IC tag 63 matches the store ID in the second store proceeds data 106*c*, the determination result is "second store". When the store ID stored in the IC tag 63 matches neither the store ID in the first store proceeds data 106*b* nor the store ID in the second store proceeds data, the determination result is "unregistered".

The fee handling unit 102*b* calculates and manages a fee. Specifically, in the case where the banknote cassette 60 is mounted and the determination result of the store determination unit 102*a* is "second store", the fee handling unit 102*b* calculates a fee on the basis of the fee setting stored in the IC tag 63. The fee handling unit 102*b* cumulatively adds the calculated fee to the fee in the corresponding second store proceeds data 106*c*.

The sales proceeds management unit 102*c* manages the proceeds from sales of each store. The sales proceeds management unit 102*c* generates the first store proceeds data 106*b* including the store ID of the first store, and registers the generated data 106*b* in the memory unit 106. The sales proceeds management unit 102*c* generates the second store proceeds data 106*c* including the store ID of the second store and registers the generated data 106*c* in the memory unit 106. When managing the proceeds from sales of a plurality of other stores, the sales proceeds management unit 102*c* generates, for each store, the store proceeds data including the store ID of each store, and registers the generated data in the memory unit 106.

When the banknote cassette 60 is mounted to the money handling apparatus 100, the sales proceeds management unit 102*c* first obtains the determination result of the store determination unit 102*a*. When the determination result is "unregistered", the sales proceeds management unit 102*c* performs control to detach the banknote cassette 60 without feeding out banknotes from the banknote cassette 60 into the banknote handling unit 110.

When the determination result of the store determination unit 102*a* is "first store" or "second store", the sales proceeds management unit 102*c* instructs the banknote handling unit 110 to store banknotes. When the banknote handling unit 110 has fed out banknotes from the banknote cassette 60 and stored the banknotes in the banknote handling unit 110, the sales proceeds management unit 102*c* cumulatively adds the monetary amount of the stored banknotes to the proceeds from sales. The sales proceeds management unit 102*c* selects either the first store proceeds data 106*b* or the second store proceeds data 106*c* in accordance with the store ID stored in the IC tag 63, and updates the proceeds from sales in the selected data. Thus, although the proceeds from sales are managed for each store, the quantity of the money stored in the money handling apparatus 100 is collectively managed as the inventory amount data 106*a*.

FIG. 12 shows specific examples of data stored in the money handling apparatus 100. As shown in FIG. 12, in the inventory amount data 106*a*, the number of pieces of money, for each denomination, stored in the money handling apparatus 100 is managed. FIG. 12 shows that the number of 10,000-yen notes is "47", and the number of 5,000-yen notes is "3".

As shown in FIG. 12, the first store proceeds data 106*b* includes the store ID, type, fee, and a day's proceeds from sales. FIG. 12 shows that the store ID is "U001", the type is "first store", the fee is "not required", and the day's proceeds from sales is "213,000 yen".

Likewise, the second store proceeds data 106*c* includes the store ID, type, fee, and day's proceeds from sales. FIG. 12 shows that the store ID is "U002", the type is "second store", the fee is "8,540 yen", and the day's proceeds from sales is "427,000 yen".

In FIG. 12, the items "type" and "fee" are provided in the first store proceeds data 106*b* as in the second store proceeds data 106*c*, but these items are not essential. For example, if the proceeds from sales of the first store and the proceeds from sales of the second store are recognized as different pieces of data and managed, the "type" in the data indicating the proceeds from sales of the first store is "first store", and the fee is "not required". Likewise, when the proceeds from sales of the first store and the proceeds from sales of the second store are recognized as different pieces of data and managed, the item of "type" need not be provided in the data indicating the proceeds from sales of the second store.

Figure 13:
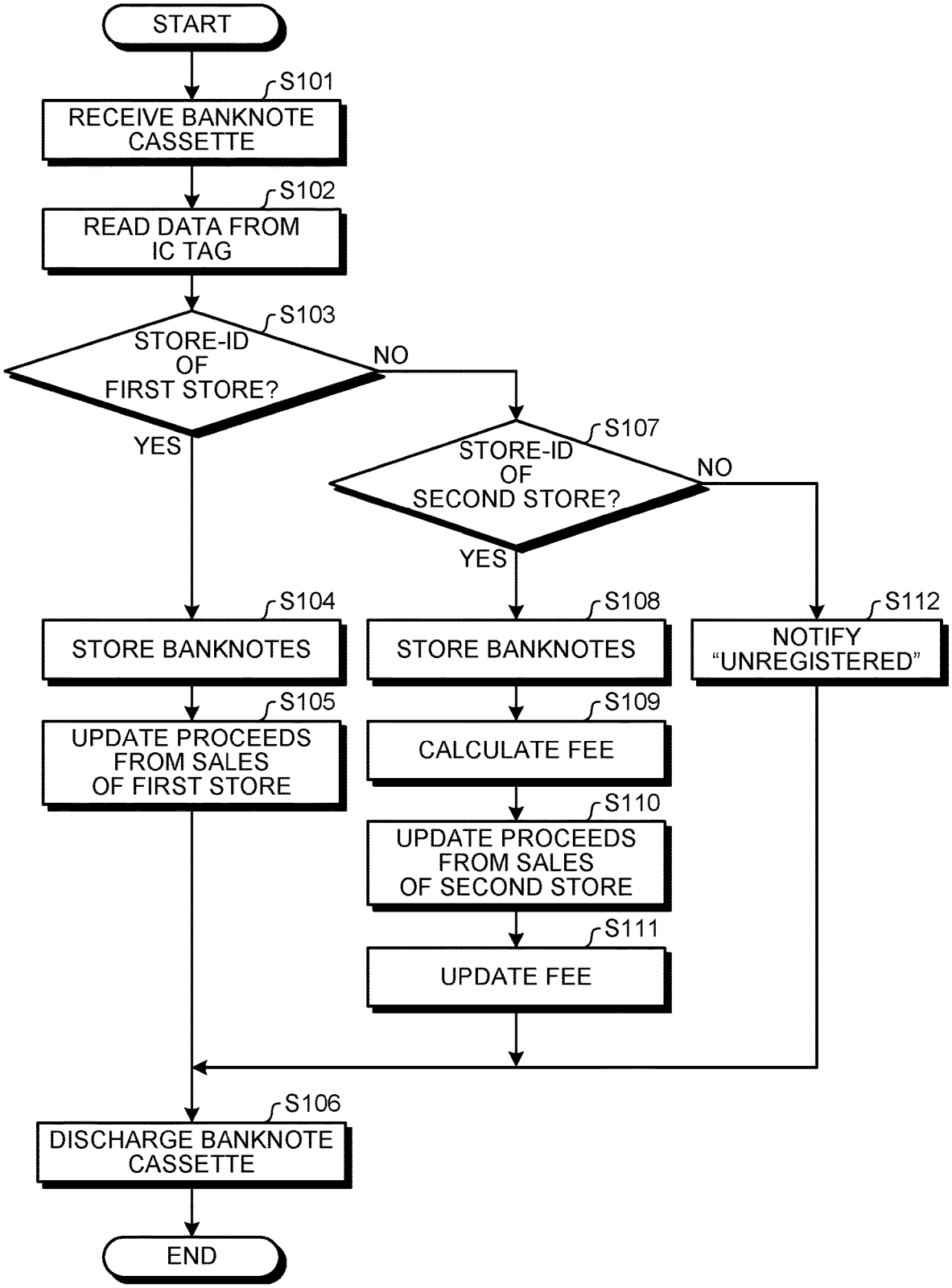
FIG. 13 is a flowchart showing a handling procedure of the money handling apparatus.

Next, the handling procedure of the money handling apparatus 100 will be described. FIG. 13 is a flowchart showing the procedure of handling performed by the money handling apparatus 100. First, when the cassette mounting unit 126 of the banknote handling unit 110 has received the banknote cassette 60 (step S101), the reader/writer 128 reads out data from the IC tag 63 of the banknote cassette 60 (step S102).

When the store determination unit 102*a* has determined that the store ID read from the IC tag 63 is the store ID of the first store (Yes in step S103), the banknote handling unit 110 feeds out banknotes from the banknote cassette 60 and stores the banknotes in the banknote handling unit 110 (step S104), and the sales proceeds management unit 102*c* updates the proceeds from sales in the first store proceeds data 106*b* (step S105).

When the store ID read from the IC tag 63 is not the store ID of the first store (No in step S103) but is the store ID of the second store (Yes in step S107), the banknote handling unit 110 feeds out banknotes from the banknote cassette 60 and stores the banknotes in the banknote handling unit 110 (step S108), and the fee handling unit 102*b* calculates a fee (step S109). Then, the sales proceeds management unit 102*c* updates the proceeds from sales in the second store proceeds data 106*c* (step S110), and the fee handling unit 102*b* updates the fee in the second store proceeds data 106*c* (step S111).

When the store ID read from the IC tag 63 is neither the store ID of the first store (No in step S103) nor the store ID of the second store (No in step S107), the sales proceeds management unit 102*c* notifies that registration corresponding to the mounted banknote cassette 60 cannot be confirmed, that is, notifies that the store ID is "unregistered" (step S112).

After step S105, step S111, and step S112, the banknote handling unit 110 discharges the banknote cassette 60 (step S106) to end the handling.

As described above, according to the present embodiment, a money handling apparatus, which is installed in a predetermined store and performs at least depositing of money as proceeds from sales of the predetermined store, is configured to receive money as proceeds from sales of other stores different from the predetermined store. The money handling apparatus determines a store corresponding to the received money, stores the received money, and stores information on proceeds from sales of each store. This configuration realizes efficient management of proceeds from sales of a store that has not introduced an apparatus for managing the proceeds from sales.

The money handling apparatus can receive, by the same method, money as the proceeds from sales of the other stores different from the predetermined store, and money stored in a predetermined in-store apparatus installed in the predetermined store.

The money handling apparatus can store at least: monetary amount information of the proceeds from sales of each of the other stores; and information on a usage fee to be paid to the predetermined store by each store.

When storing money of the other stores therein, the money handling apparatus can calculate a usage fee of each store, based on the amount of the stored money and a predetermined fee rate, and can cumulatively add the calculated usage fee to the information, on the usage fee of each store, stored in the memory unit.

When storing money of the other stores therein, the money handling apparatus can cumulatively add a predetermined basic fee to the information, on the usage fee of each store, stored in the memory unit.

The money handling apparatus can store therein money that has been collected from a change machine communicably connected to a cash register having a POS function.

When a banknote cassette, which has been taken out from the change machine and functions as a storage cassette in which the money in the change machine is stored, is mounted to a predetermined mounting unit of the money handling apparatus, the money handling apparatus can feed out the money from the storage cassette and receive the money.

The storage cassette may be provided with a memory, for the cassette, in which information on the fee is stored. The memory for the cassette stores therein store identification information that uniquely identifies each store, and the money handling apparatus can determine a store corresponding to the received money, on the basis of the store identification information stored in the memory for the cassette.

In the above embodiment, the memory for the cassette, that is, the IC tag 63 of the banknote cassette 60, is used for reading out a store ID. However, the IC tag 63 can be used for any purpose. For example, whether or not collection of money has been properly performed may be determined by comparing the amount of stored money which has been read from the IC tag 63 with the denomination and the number of banknotes fed out from the banknote cassette 60.

When the money handling apparatus 100 writes, in the IC tag 63, data regarding the proceeds from sales of the corresponding store, and the banknote cassette 60 is returned to the store and mounted to the change machine 30, the proceeds from sales of the store managed by the money handling apparatus 100 can be displayed on the change machine 30 and the POS register 20.

In the above embodiment, the money handling apparatus 100 is configured to receive banknotes as proceeds from sales from the banknote cassette 60, and read the store ID from the IC tag 63 attached to the banknote cassette 60. However, use of the banknote cassette 60 is not essential. The money handling apparatus 100 may directly receive cash as proceeds from sales. In this case, the money handling apparatus 100 can be configured to read a store ID from a storage medium such as a card. Alternatively, the money handling apparatus 100 may be configured to receive banknotes as proceeds from sales from a banknote cassette having no IC tag, and read a store ID from a card.

The store in which the money handling apparatus 100 is installed may not be provided with the change machine 30. In this case, the money handling apparatus 100 will manage the fees from all the stores. Further, a place where the money handling apparatus 100 is installed is not limited to a store.

The fee may be paid at any time, although not described in the above embodiment. For example, the accumulated fee may be paid on the 25th of each month. Alternatively, the fee may be paid each time the banknote cassette 60 is mounted to collect the proceeds from sales.

The present invention provides a money handling apparatus which is installed in a predetermined store (i.e. store A) and is configured to handle depositing of money as proceeds from sales of at least the predetermined store. The apparatus includes: a money receiving unit configured to receive money as proceeds from sales of at least one of other stores (i.e. store B) different from the predetermined store; a determination unit configured to determine a store corresponding to the money received by the money receiving unit; a money storage unit configured to store therein the money received by the money receiving unit; and a memory unit configured to store therein information on proceeds from sales of each store.

According to the present invention, in the above configuration, the money receiving unit receives: the money as the proceeds from sales of at least one of the other stores different from the predetermined store; and money stored in a predetermined in-store apparatus installed in the predetermined store.

According to the present invention, in the above configuration, the memory unit stores therein at least: monetary amount information on a monetary amount of the proceeds from sales of at least one of the other stores; and information on a usage fee to be paid to the predetermined store by at least one of the other stores.

According to the present invention, in the above configuration, when the money of at least one of the other stores is stored in the money storage unit, the usage fee is calculated based on a monetary amount of the stored money and a predetermined fee rate, and the calculated usage fee is cumulatively added to the information, on the usage fee, stored in the memory unit.

According to the present invention, in the above configuration, when the money of at least one of the other stores is stored in the money storage unit, a predetermined basic fee is cumulatively added to the information on the usage fee, stored in the memory unit.

According to the present invention, in the above configuration, the predetermined in-store apparatus is a change machine communicably connected to a cash register having a point-of-sales management function.

According to the present invention, in the above configuration, when a container, which has been taken out from the change machine and in which money in the change machine is stored, is mounted to a predetermined mounting unit, the money receiving unit feeds out the money from the container and receives the money.

According to the present invention, in the above configuration, the container has a memory in which at least the information on the usage fee is stored.

According to the present invention, in the above configuration, the memory for the cassette stores therein store identification information that uniquely identifies each store, and the determination unit determines a store corresponding to the money received by the money receiving unit, on the basis of the store identification information stored in the memory for the cassette.

According to the present invention, in the above configuration, the memory for the cassette stores therein store identification information that uniquely identifies each store, and the determination unit determines a store corresponding to the money received by the money receiving unit, on the basis of the store identification information stored in the memory for the cassette.

The present invention provides a money handling system comprising: a money handling apparatus which is installed in a predetermined store and is configured to handle depositing of money as proceeds from sales of at least the predetermined store; a first in-store apparatus installed in the predetermined store; and a second in-store apparatus installed in another store different from the predetermined store. The money handling apparatus includes: a money receiving unit configured to receive money stored in the first in-store apparatus and money stored in the second in-store apparatus; a determination unit configured to determine a store corresponding to money received by the money receiving unit; a money storage unit configured to store the money received by the money receiving unit; and a memory unit configured to store therein information on proceeds from sales for each store.

The present invention provides a money handling method performed by a money handling apparatus which is installed in a predetermined store, and is configured to handle depositing of money as proceeds from sales of at least the predetermined store. The method includes: a money receiving step of receiving money as proceeds from sales of another store different from the predetermined store; a determination step of determining a store corresponding to the money received in the money receiving step; a money storage step of storing, in a money storage unit, the money received in the money receiving step; and a memory step of storing, in a memory unit, information on proceeds from sales for each store.

According to the present invention, proceeds from sales of a store that has not introduced an apparatus for managing the proceeds from sales can be efficiently managed.

Each of the components described in the above embodiment is only schematically illustrated in the figures, and does not need to be physically configured as illustrated in the figures. That is, a specific form of distribution/integration of the respective devices is not limited to the form illustrated in the figures. The entire or part of the devices may be configured to be functionally or physically distributed/integrated in an arbitrary unit corresponding to various loads and/or use situations.

The money handling apparatus, the money handling system, and the money handling method according to the present invention are useful in efficiently managing proceeds from sales of a store that has not introduced an apparatus for managing the proceeds from sales.

What is claimed is:

1. A money handling apparatus which is configured to manage money proceeds from sales of a plurality of stores including a first store and a second store and is installed in the first store and not in the second store, the money handling apparatus comprising:

a money receiving unit configured to deposit, to the money handling apparatus, the money including first money collected from the first store as proceeds from sales of the first store and second money collected from the second store as proceeds from sales of the second store;

a determination unit configured to determine whether the money deposited by the money receiving unit is the first money or the second money;

a money storage unit configured to store therein the money deposited by the money receiving unit; and a memory unit configured to store therein information including first information on proceeds from sales of each store, and second information on a usage fee to be paid to the first store by the second store, the first information including information on a monetary amount of the proceeds from sales of the second store and the second information including information on a monetary amount of the usage fee to be paid to the first store by the second store, wherein when the determination unit determines that the money deposited to the money handling apparatus is the first money, the first information is updated and the second information is not updated in the memory unit, and when the determination unit determines that the money deposited to the money handling apparatus is the second money, the first information and the second information are updated in the memory unit.

2. The money handling apparatus according to claim 1, wherein the first money collected from the first store and deposited to the money handling apparatus by the money receiving unit is money that has been stored in a first in-store apparatus installed in the first store, and the second money collected from the second store and deposited to the money handling apparatus by the money receiving unit is money that has been stored in a second in-store apparatus installed in the second store.

3. The money handling apparatus according to claim 2, wherein the first in-store apparatus is a change machine communicably connected to a cash register having a point-of-sales function and is configured to store the money as the proceeds from sales of the first store.

4. The money handling apparatus according to claim 3, further comprising a mounting unit configured to detachably mount a container, wherein, when the container storing the first money as the proceeds from sales of the first store is taken out from the change machine and mounted to the mounting unit, the money receiving unit is configured to feed out the stored first money from the container and deposit the fed first money to the money handling apparatus.

5. The money handling apparatus according to claim 4, wherein the container comprises a container memory in which at least the information on the usage fee to be paid to the first store by the second store is stored.

6. The money handling apparatus according to claim 5, wherein the container memory stores therein store identification information that uniquely identifies each store, and the determination unit determines a store corresponding to the money deposited to the money handling apparatus by the money receiving unit, on the basis of the store identification information stored in the container memory.

7. The money handling apparatus according to claim 1, wherein when the second money is stored in the money storage unit as the proceeds from sales of the second store, the usage fee is calculated based on a monetary amount of the stored second money and a predetermined fee rate, and the calculated usage fee is cumulatively added to the information on the usage fee, stored in the memory unit.

8. The money handling apparatus according to claim 1, wherein when the second money is stored in the money storage unit as the proceeds from sales of the second store, a predetermined basic fee is cumulatively added to the information on the usage fee, stored in the memory unit.

9. The money handling apparatus according to claim 1, wherein a first usage fee rate is applied when the determination unit determines that the money deposited to the money handling apparatus is the first money collected from the first store, and a second usage fee rate different from the first usage fee rate is applied when the determination unit determines that the money deposited to the money handling apparatus is the second money collected from the second store.

10. A money handling system comprising:

a money handling apparatus configured to manage money proceeds from sales of a plurality of stores including a first store and a second store, the money handling apparatus being installed in the first store and not in the second store;

a first in-store apparatus installed in the first store; and a second in-store apparatus installed in the second store, wherein the money handling apparatus comprises:

a money receiving unit configured to deposit, to the money handing apparatus, money including first money stored in the first in-store apparatus and collected as the proceeds from sales of the first store, and second money stored in the second in-store apparatus and collected as the proceeds from sales of the second store;

a determination unit configured to determine whether the money deposited by the money receiving unit is the first money or the second money;

a money storage unit configured to store the money deposited by the money receiving unit; and a memory unit configured to store therein information including first information on proceeds from sales for each store, and second information on a usage fee to be paid to the first store by the second store, the first information including information on a monetary amount of the proceeds from sales of the second store and the second information including information on a monetary amount of the usage fee to be paid to the first store by the second store, wherein when the determination unit determines that the money deposited to the money handling apparatus is the first money, the first information is updated and the second information is not updated in the memory unit, and when the determination unit determines that the money deposited to the money handling apparatus is the second money, the first information and the second information are updated in the memory unit.

11. The money handling system according to claim 10, wherein the first money collected from the first store and deposited to the money handling apparatus by the money receiving unit is the money that has been stored in the first in-store apparatus installed in the first store, and the second money collected from the second store and deposited to the money handling apparatus by the money receiving unit is the money that has been stored in the second in-store apparatus installed in the second store.

12. The money handling system according to claim 11, wherein the first in-store apparatus is a change machine communicably connected to a cash register having a point-of-sales function and is configured to store the first money as the proceeds from sales of the first store.

13. The money handling system according to claim 12, further comprising a container being capable of being detachably mounted to the first in-store apparatus, the second in-store apparatus and the receiving unit of the money handling apparatus, wherein when the container is mounted to the first in-store apparatus, the first money stored in the first in-store apparatus is transported to and stored in the container, when the container is mounted to the second in-store apparatus, the second money stored in the second in-store apparatus is transported to and stored in the container, and when the container storing the money is mounted to the receiving unit of the money handling apparatus, the money receiving unit is configured to feed out the stored money from the container and deposit the fed money to the money handling apparatus.

14. The money handling system according to claim 13, wherein the container comprises a container memory in which at least the information on the usage fee to be paid to the first store by the second store is stored.

15. The money handling system according to claim 14, wherein the container memory stores therein store identification information that uniquely identifies each store, and the determination unit determines a store corresponding to the money deposited to the money handling apparatus by the money receiving unit, on the basis of the store identification information stored in the container memory.

16. The money handling system according to claim 10, wherein when the second money is stored in the money storage unit as the proceeds from sales of the second store, the usage fee is calculated based on a monetary amount of the stored second money and a predetermined fee rate, and the calculated usage fee is cumulatively added to the information on the usage fee, stored in the memory unit.

17. The money handling system according to claim 10, wherein when the second money is stored in the money storage unit as the proceeds from sales of the second store, a predetermined basic fee is cumulatively added to the information on the usage fee, stored in the memory unit.

* * * * *